US010050360B2

(12) United States Patent
Han

(10) Patent No.: US 10,050,360 B2
(45) Date of Patent: Aug. 14, 2018

(54) INTERFACE CARD ADAPTING DEVICE STRUCTURE

(71) Applicant: EVGA CORPORATION, New Taipei (TW)

(72) Inventor: Tai-Sheng Han, New Taipei (TW)

(73) Assignee: EVGA CORPORATION, New Taipei (TW)

( * ) Notice: Subject to any disclaimer, the term of this patent is extended or adjusted under 35 U.S.C. 154(b) by 0 days.

(21) Appl. No.: 15/293,272

(22) Filed: Oct. 13, 2016

(65) Prior Publication Data

US 2018/0109021 A1 Apr. 19, 2018

(51) Int. Cl.
*H01R 12/00* (2006.01)
*H01R 12/72* (2011.01)
*H01R 12/70* (2011.01)

(52) U.S. Cl.
CPC ..... *H01R 12/721* (2013.01); *H01R 12/7029* (2013.01); *H01R 2201/06* (2013.01)

(58) Field of Classification Search
CPC ..... H01R 12/721; H01R 12/7029; H01R 2201/06
USPC ..... 439/39, 76.1, 638, 946, 947
See application file for complete search history.

(56) References Cited

U.S. PATENT DOCUMENTS 6,174,205 B1 * 1/2001 Madsen ..... H01R 27/02 439/638
8,830,660 B2 * 9/2014 Kuehl ..... F25D 23/00 361/601
9,033,717 B2 * 5/2015 Allard ..... F25D 23/00 439/131
9,600,040 B1 * 3/2017 Han ..... G06F 1/20
2011/0294309 A1 * 12/2011 Chen ..... H04L 49/45 439/65

* cited by examiner

*Primary Examiner* — Khiem Nguyen
(74) *Attorney, Agent, or Firm* — Leong C. Lei

(57) ABSTRACT

An interface card adapting device structure, mainly includes an outer frame body, transmission conductors, a connector and fixing elements, where the transmission conductors are accommodated in the outer frame body, each of them comprises a first contact portion and second contact portion; the connector is in electric connection with the first contact portion selectively at a predetermined position thereof and fixed by the fixing elements. whereby, when the plugging-in position of an external connector is to be changed, the outer frame body is fixed to the interface card, the connector is inserted in the interface card connector, and the fixing elements is used to fix it and the second first contact portion together; at this time, the external connector can then be plugged into the second contact portion. Thus, the insertion direction and position can be changed without being bound by smaller space, being more extensive.

5 Claims, 4 Drawing Sheets

INTERFACE CARD ADAPTING DEVICE STRUCTURE

TECHNICAL FIELD OF THE INVENTION

The present invention relates to an interface card adapting device structure, and more particularly to an interface card adapting device structure, allowing the plugging-in position of an external connector to be changed without being bound by a particular location.

DESCRIPTION OF THE PRIOR ART

Various peripheral devices (e.g. speakers, screen, data card, sound card and display card) are also the important roles for data transfer and command control in current computers besides a central processor and memories being used as information processing centers. A variety of interface cards are added on expansion slots of a personal computer to allow data transfer between peripheral devices and the computer and be used for expansion purposes. Among these interface cards, a video card (graphics cards) will be caused to be stuck with other interface cards around it when an external power line is connected because of space sizes after it is inserted in a computer motherboard; it is simple to say that the space size is not enough for the insertion of the external power line, which will be broken or separated from the connector if it is inserted recklessly.

SUMMARY OF THE INVENTION

To overcome the defects mentioned above, and make the plugging-in position of an external connector changeable without being bound by a particular position, the present invention is proposed.

One object of the present invention is to provide an interface card adapting device structure, achieving electric conduction smoothly in a small space by changing the plugging position of an external connector into an interface card connector through the design of a transmission conductor.

Another object of the present invention is to provide an interface card adapting device structure, allowing overall wiring to be more flexible, line directions to be more consistent by changing the plugging-in position of an external connector, and relatively, the entirety is allowed to be more eye-appealing since the wiring is more consistent.

To achieve the objects mentioned above, the present invention proposes an interface card adapting device structure, including: an outer frame body, capable of being in connection with an interface card; at least one transmission conductor, accommodated in the outer frame body, and comprising at least one first contact portion and at least one second contact portion positioned differently from the first contact portion; at least one connector, in electric connection with the first contact portion, and capable of being positioned thereon freely according to demand; and at least one fixing element, adapted to fix the connector to the first contact portion after the position is selected. Thus, the outer frame body may be installed on an interface card, and the connector and interface card connector are inserted with each other if the outer connector cannot be inserted in the interface card connector smoothly. At this time, signals or power can then be transferred to different positions through the transmission conductor; it is simple to say that the external connector can then be conducted with the interface card through the contact thereof with the second contact portion because of the different configuration positions of the first and second contact portions.

DETAILED DESCRIPTION OF THE PREFERRED EMBODIMENTS

Figure 1:
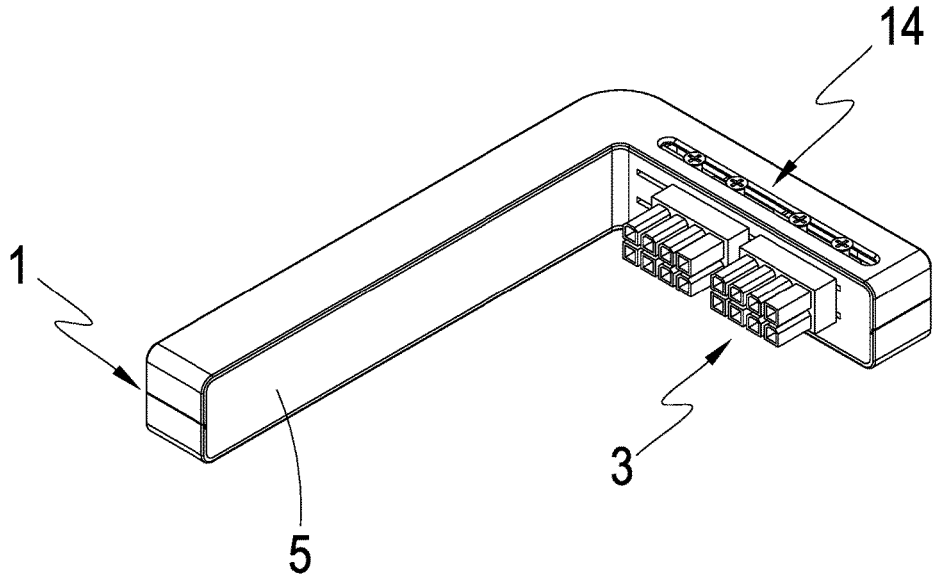
FIG. 1 is a perspective view of a preferred embodiment of the present invention.
Figure 2:
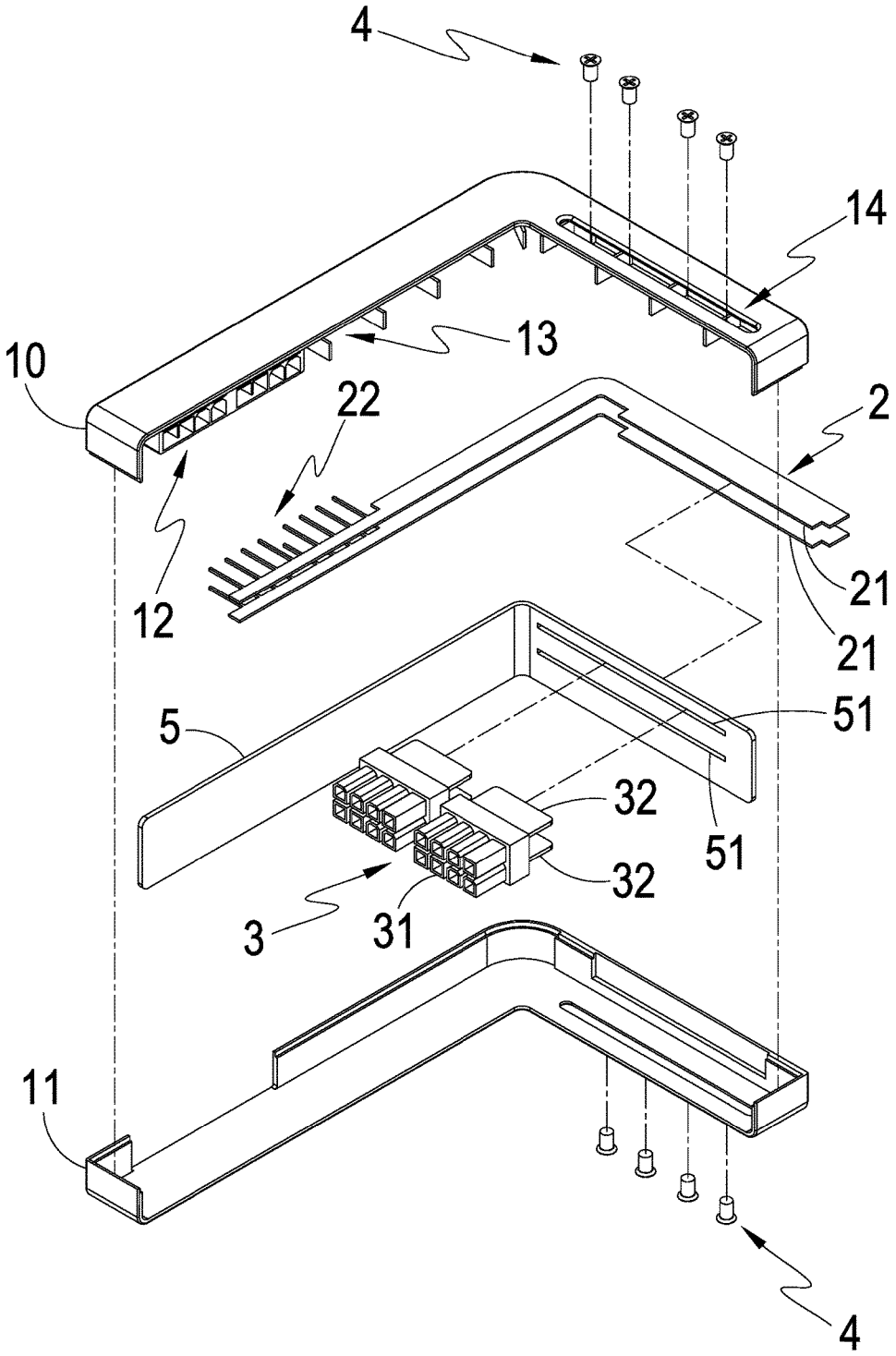
FIG. 2 is an exploded view of the embodiment of the present invention.
Figure 3:
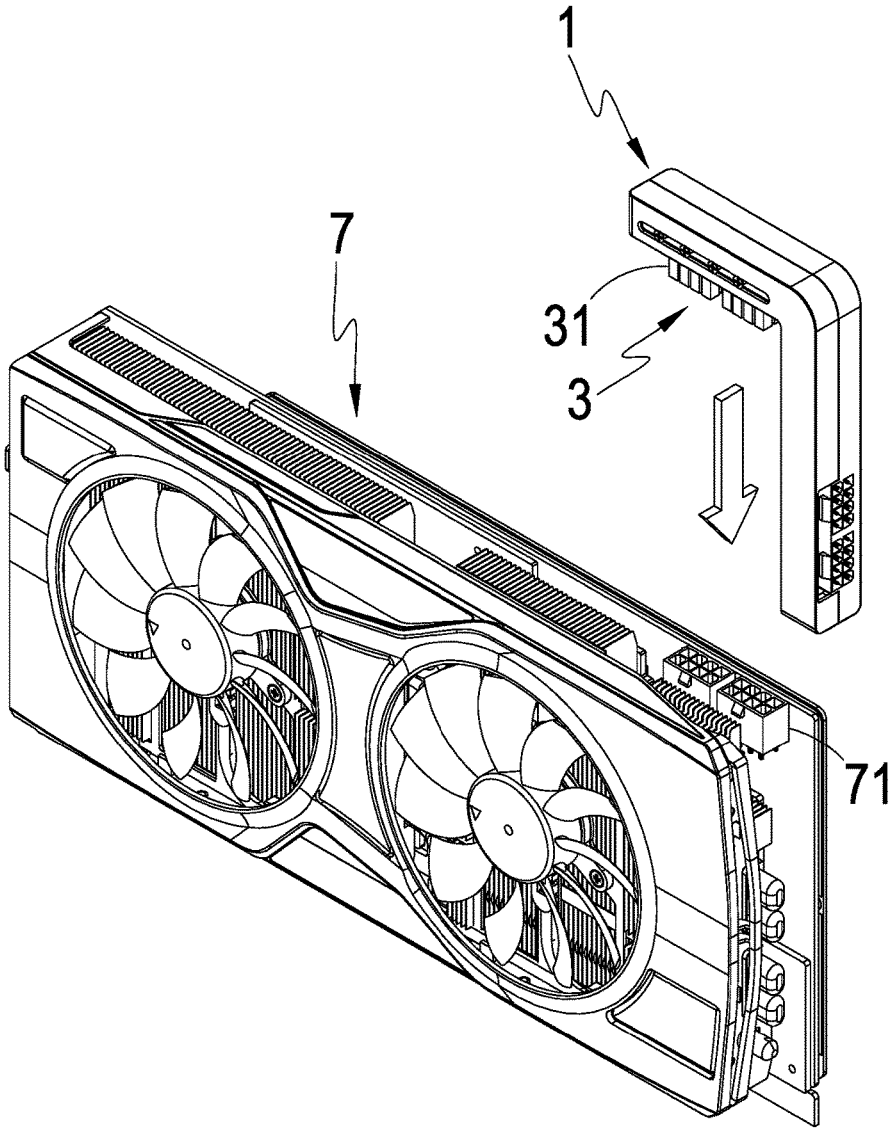
FIG. 3 is a schematically perspective view of the embodiment of the present invention in combination with an interface card.
Figure 4:
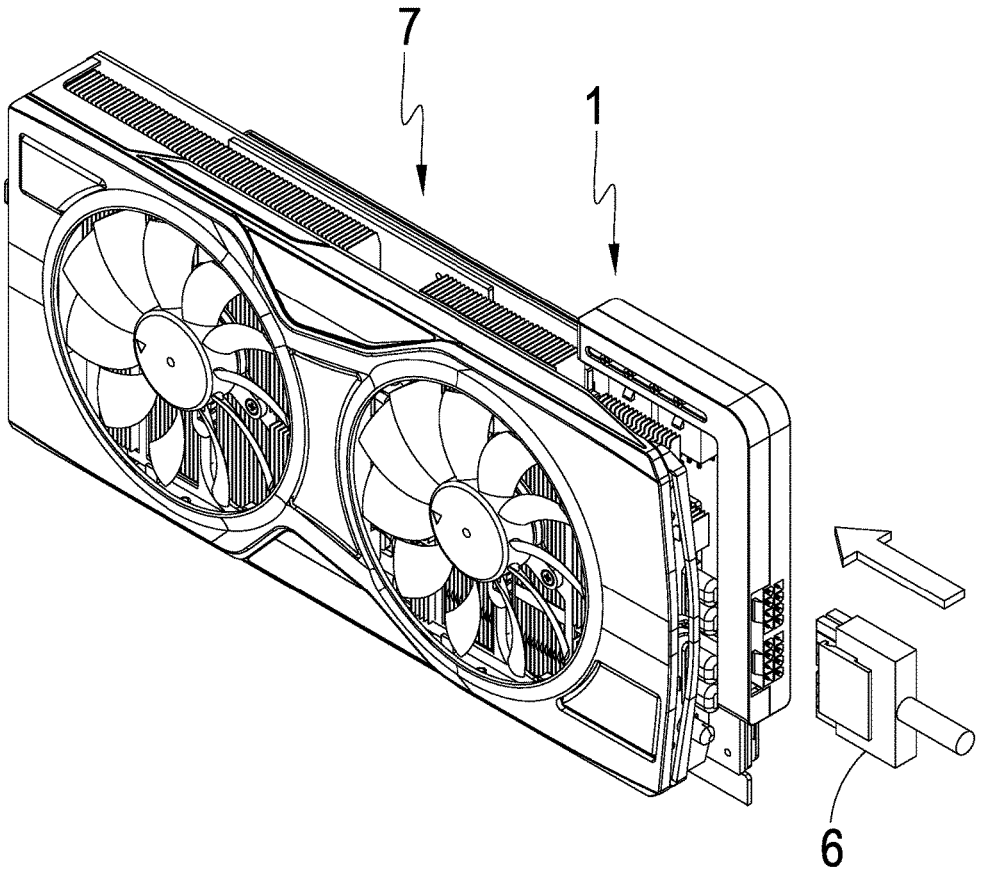
FIG. 4 is a schematically perspective view of the embodiment of the present invention, where an external connector is to be plugged in a second contact portion.

Referring to FIGS. 1 and 2, which respectively a perspective view and exploded view of a preferred embodiment according to the present invention, it can be clearly seen from the figures that an interface card adapting device structure of the present invention includes:

an outer frame body 1, capable of being in connection with an interface card and constituted by a upper outer frame body 10 and lower outer frame body 11 in combination with the upper frame body 10, the outer frame body 1 including at least one expansion slot 12 for the accommodation of a second contact portion 22 mentioned below, a plurality of bracket isolation units 13, and at least one through hole 14 allowing a fixing element 4 mentioned below to be passed through;

at least one transmission conductor 2, accommodated inside the outer frame body 1, and including at least one first contact portion 21 and at least one second contact portion 22 positioned differently from the first contact portion 21;

at least one connector 3, in electric connection with the first contact portion 21 selectively at a predetermined location thereof, the connector 3 including an insertion portion 31 capable of mutual insertion with an interface card connector, and a plurality of conducting portions 32 in electric connection with the first contact portion 21;

at least one fixing element 4, adapted to position the connector 3; and a covering body, configured on an inner side of the outer frame body 1, and have at least one guide hole 51 allowing the conducting portion 32 to be passed through.

In addition, in the embodiment, the transmission conductors 2 number 2; the upper, lower transmission conductors 2 are separated by the bracket isolation units 13, thereby avoiding short-circuit.

Referring to FIGS. 1 to 4, which respectively are a perspective view, exploded view, schematically perspective view in connection with an interface card and schematically perspective view with the insertion of an external connector in a second contact portion of the embodiment according to the present invention, it can be clearly seen from the figures that the outer frame body 1 may be in connection with the side of an interface card 7 if the working space of plugging-in is too small when a user wants to plug an external connector 6 into an interface card connector 71, and at the same time, the insertion portion 31 of the connector 3 and interface card connector are inserted into each other to form electric conduction. Thus, signals from the interface card connector 71 can then be transmitted to the second contact portion 22 via the insertion portion 31, conduction portion 32 and first contact portion 21. Furthermore, since the spacing specification of the interface card connector 71 of each interface card 7 is different slightly, the connector 3 may be moved to align with the interface card connector 71, and the fixing elements 4 may then passed through the through hole 14 (a long perforation) to fix the conduction portion 32 of the connector 3 and first contact portion 21 together tightly by means of locking or solid contact to form electric connection. Thereafter, the external connector 6 can then be plugged into the expansion slot 12 and form a conduction state with the second contact portion 22, thereby achieving the advantage of plugging position conversion.

The present invention has the following advantages over the prior art:

1. the electric conduction can be achieved smoothly in a small space by changing the plugging position of the external connector 6 into the interface card connector 71 through the design of the transmission conductor 2; and
2. overall wiring is allowed to be more flexible, and line directions more consistent by changing the plugging position of the external connector 6, and relatively, the entirety is further allowed to be more eye-appealing since the wiring is more consistent.

I claim:

1. An interface card adapting device structure, comprising an outer frame body, capable of being in connection with an interface card;

at least one transmission conductor, which is accommodated in said outer frame body and comprises at least one first contact portion and at least one second contact portion positioned differently from said first contact portion;

at least one connector, which is movable with respect to and in electric connection with said first contact portion by being selectively set at a position with respect to the first contact portion; and at least one fixing element, which selectively fixes the connector in position;

wherein the outer frame body comprises at least one through hole, which is in the form of a long perforation, to receive the at least one fixing element to pass therethrough to engage the first contact portion to selectively set the connector at a position with respect to the first contact portion of the at least one transmission conductor; and wherein the connector comprises an insertion portion, which is adapted to insert into an interface card connector, and a plurality of conducting portions in electric connection with the first contact portions.

2. The structure according to claim 1, wherein said outer frame body comprises at least one expansion slot for the accommodation of said second contact portion.

3. The structure according to claim 1, wherein said outer frame body comprises a plurality of bracket isolation units.

4. The structure according to claim 1, wherein a covering body is configured inside said outer frame body, and said covering body has at least one guide hole allowing said conducting portion to be passed through.

5. The structure according to claim 1, wherein said outer frame body comprises an upper frame body and a lower frame body in combination with said upper frame body.

* * * * *